US005513670A

United States Patent [19]

Childress et al.

[11] Patent Number: 5,513,670

[45] Date of Patent: May 7, 1996

[54] SUN SHADE

[76] Inventors: David E. Childress; Frank Alexander, both of 8221 Delongtre Ave. #14, Los Angeles, Calif. 90046

[21] Appl. No.: 291,150

[22] Filed: Oct. 24, 1994

[51] Int. Cl.[6] ..... E04H 15/48

[52] U.S. Cl. ..... 135/154; 135/156; 135/900

[58] Field of Search ..... 135/128, 133, 135/143, 147, 148, 151, 153, 154, 155, 156, 118

[56] References Cited

U.S. PATENT DOCUMENTS

| | | | |
|---|---|---|---|
| 2,290,786 | 7/1942 | Varady | 135/143 X |
| 2,499,897 | 3/1950 | Winquist | 135/143 X |
| 2,543,597 | 2/1951 | Peery | 135/133 X |
| 2,725,887 | 12/1955 | Belfer | 135/147 |
| 2,771,125 | 11/1956 | Dobbins | 135/153 X |
| 2,781,767 | 2/1957 | Blankenship, Jr | 135/143 X |
| 2,922,653 | 1/1960 | O'Brien | 135/118 X |
| 5,088,514 | 2/1992 | House et al. | 135/154 X |

*Primary Examiner*—Lanna Mai
*Attorney, Agent, or Firm*—Goldstein & Associates

[57] ABSTRACT

The invention is a sun shade, for use by a person lying on a ground surface, having an visor, a lower panel, and a hinge connecting the visor and lower panel. Legs extend from the hinge. The angle of the visor may be varied at the hinge with respect to the lower panel, to selectively block the sun to the person's head while allowing the sunlight to reach the person's torso.

9 Claims, 5 Drawing Sheets

SUN SHADE

BACKGROUND OF THE INVENTION

The invention relates to a sun shade. More particularly, the invention relates to a sun shade for blocking the suns rays from reaching the head of a person who is in a reclined position, while allowing the suns rays to reach the rest of their body.

People enjoy laying beach in the sunshine. Sunbathing can be relaxing and can enhance one's appearance. However, while laying in the sun, many people find it undesirable to have the sun shine directly upon their face. The hot sun can be irritating to sensitive facial skin, and over-exposure can lead to various skin conditions. In addition, over-exposure of the suns rays can lead to premature facial aging.

Furthermore, people often bring young children to the beach. Children are especially sensitive to the sun. A baby's young skin cannot tolerate the sun for too long.

People have sought to selectively block the suns rays using umbrellas which either attach to their chair, or stick into the ground. However, it is difficult use an umbrella to selectively block the sun from portions of the body, such as the face, while allowing the suns rays to reach the remainder of the body.

Others have devised sun shades which are designed to attach to beach chairs. However, the reality is that most people do not bring chairs or lounges to the beach: they enjoy laying on the sand.

While these units units may be suitable for the particular purpose employed, or for general use, they would not be as suitable for the purposes of the present invention as disclosed hereafter.

SUMMARY OF THE INVENTION

It is an object of the invention to produce a sun shade that effectively blocks the suns rays.

It is another object of the invention to produce a sun shade that is free-standing, so that it can be used by a person laying on the ground.

It is yet another object of the invention to produce a sun shade that may be used to shield a baby from the suns rays.

It is further object of the invention to produce a sun shade that is lightweight for portability, inexpensive to manufacture, and that folds for easy storage.

It is a still further object of the invention to produce a sun shade that has provisions for holding items such as portable radios, books, and sun-tan lotion, in a shaded location.

The invention is a sun shade, for use by a person lying on a ground surface, having an visor, a lower panel, and a hinge connecting the visor and lower panel. Legs extend from the hinge. The angle of the visor may be varied at the hinge with respect to the lower panel, to selectively block the sun to the person's head while allowing the sunlight to reach the person's torso.

To the accomplishment of the above and related objects the invention may be embodied in the form illustrated in the accompanying drawings. Attention is called to the fact, however, that the drawings are illustratative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
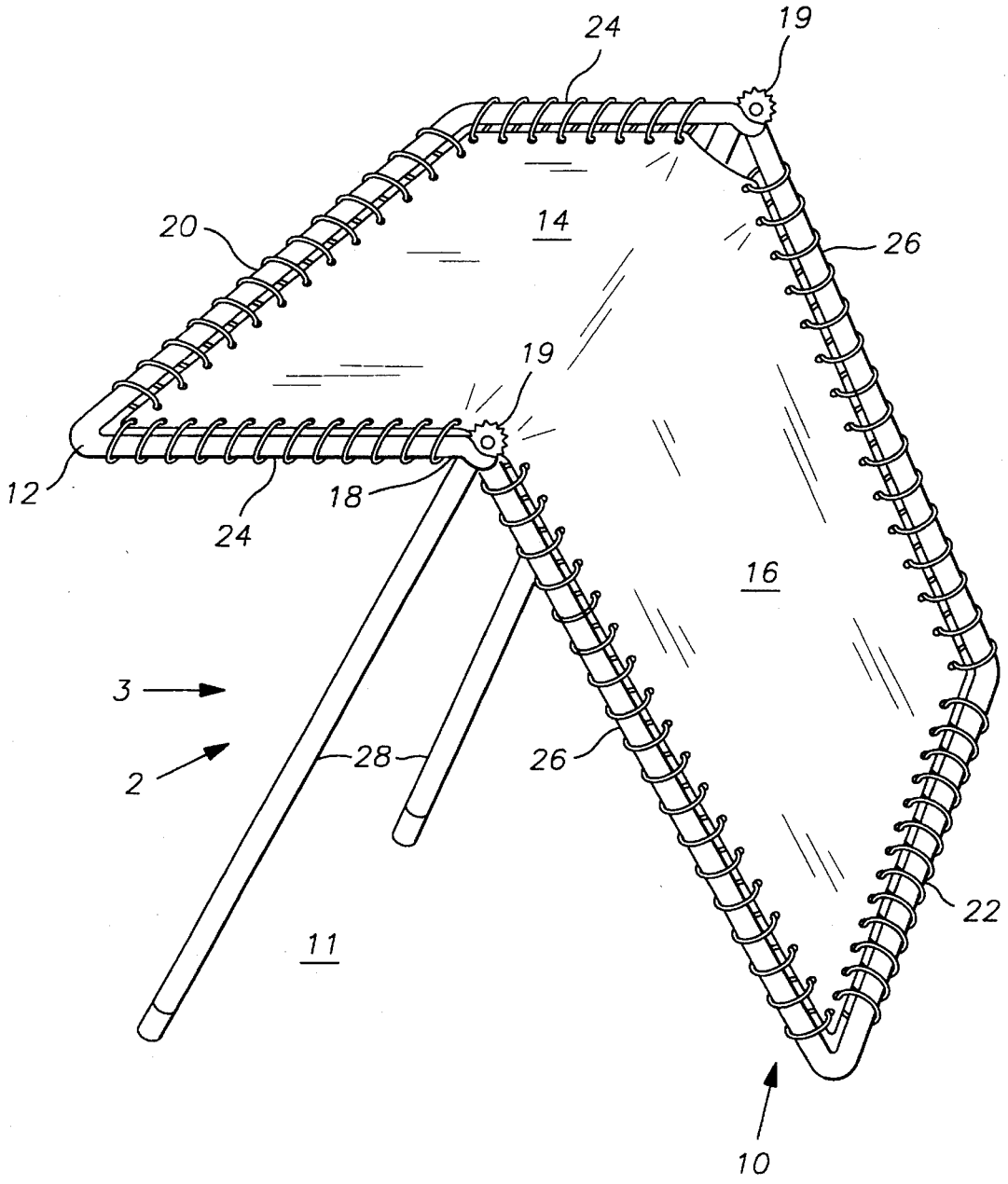
FIG. 1 is a diagrammatic perspective view of the instant invention.

FIG. 1 illustrates a sun shade 10, having a frame 12. The frame 12 may comprise tubes of aluminum or plastic. The sun shade has a visor 14, and a lower panel 16. The visor 14 and lower panel 16 are adjacent, and are joined by a hinge 18.

The visor 14 and lower panel 16 are both u-shaped. The u-shapes are joined at the hinge 18 to form a closed 6-sided figure. The visor 14 has an upper edge 20 at the base of its u-shape, and the lower panel 16 has a lower edge 22 at the base of its u-shape. The upper edge 20 and lower edge 22 are substantially parallel.

The visor has two upper struts 24 which extend forward from the upper edge 20, and are substantially parallel to one another. The lower panel extends rearward from the hinge 18 and has two lower struts 26 which extend from the lower edge 22, and are substantially parallel to one another.

Each lower strut 26 is joined with one of the upper struts 24 at a hinge coupler 19.

Two legs 28 extend from the hinge 18, each leg extending from the hinge coupler 19 at opposite ends of the hinge.

The sun shade 10 rests upon a ground surface 11, with the lower edge 22 and legs 28 resting upon the ground surface 11 to support the sun shade 10.

The set-up of the sun shade 10 is described as follows. The visor 14 is pivoted about the hinge 18 until the visor 14 and lower panel 16 form an obtuse angle. The sun shade 10 is held so that the legs 28 are swung toward the middle of the angle, to bisect or divide the angle formed from the visor 14 and lower panel 16. An isosceles triangle is formed between the ground surface, the legs 28 and the lower struts 26. The visor 14 is adjusted so that it is substantially parallel to the ground.

The sun shade 10 is typically used by a person, having a head, shoulders, and a torso. The person lays on the ground surface 11 beneath the sun shade, with their shoulders between the legs 28 of the sun shade. The visor 14 is then pulled downward until it blocks sunlight to the head, while allowing it to reach the torso.

Figure 2:
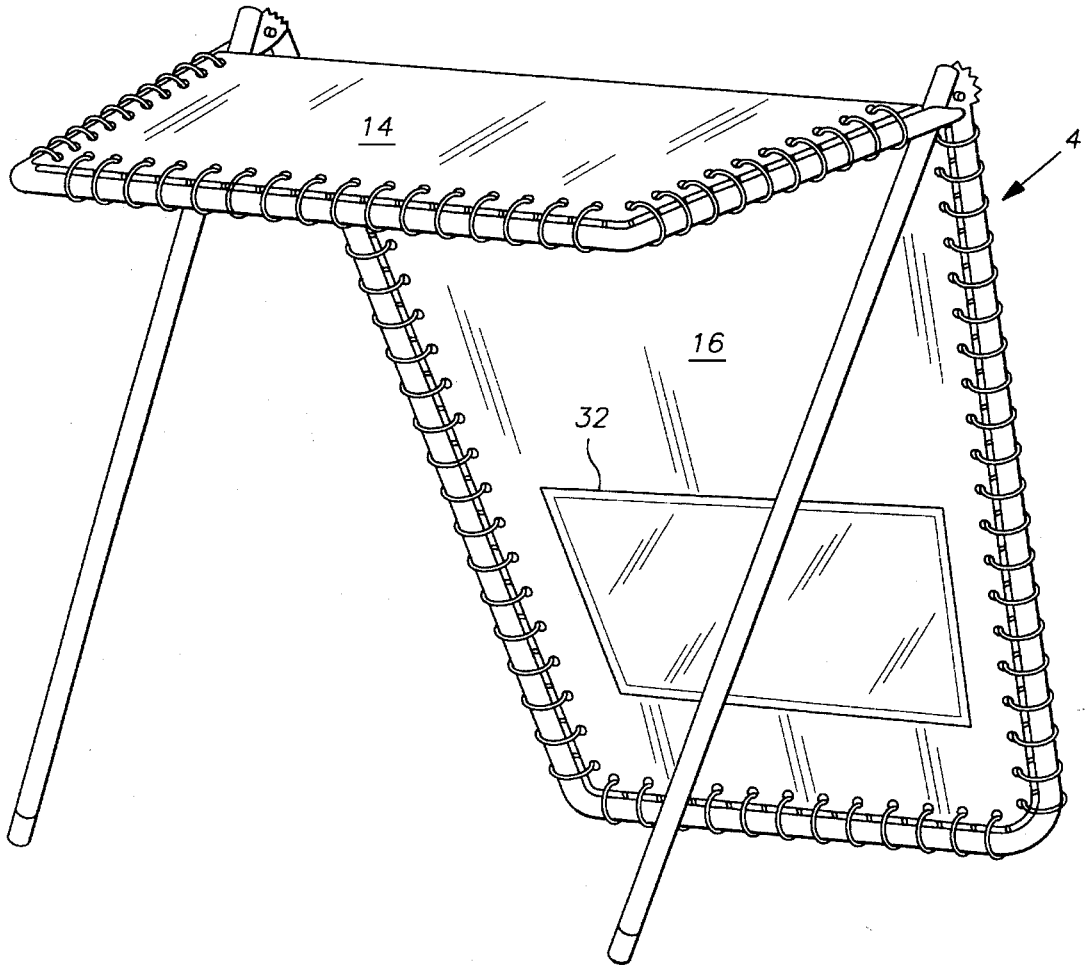
FIG. 2 is a diagrammatic perspective view of the invention, according to arrow 2 in FIG. 1.

FIG. 2 illustrates the sun shade 10, detailing an inner side 30. The utility pocket 32 is attached to the lower panel 16, to hold a variety of items. The utility pocket 32 may be used to hold a portable radio, a book, food, a drink, suntan lotion, or sunglasses in a shaded location. The utility pocket 32, may be attached to either the lower panel 16 or the visor 14.

Figure 3:
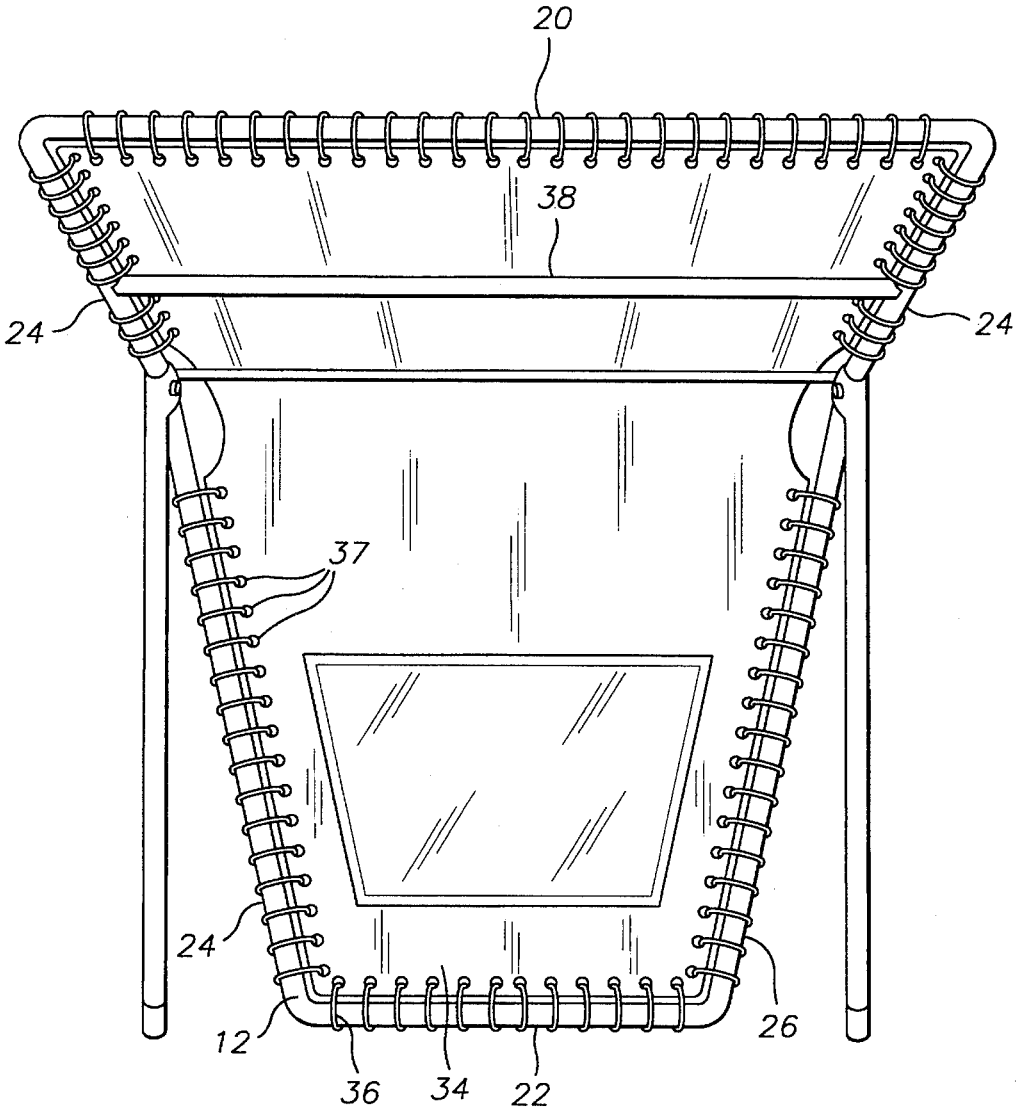
FIG. 3 is an elevational view of the invention, according to arrow 3 in FIG. 1.

As shown in FIG. 3, a fabric covering 34 is attached to the frame 12 with lacing 36. The fabric covering 34 may comprise a coated canvas material. The fabric covering 34 is stretched between the upper edge 20 and lower edge 22, and between each of the upper struts 24 and each of the lower struts 26. The fabric is tensioned with a tension bar 38. The tension bar 38 is substantially parallel to the upper edge 20 and lower edge 22, extends between the two upper struts 24, and may be mounted between the hinge 18 and the upper edge 20.

The fabric covering 34 can be a one piece canvas tarpaulin. Preferably, the lacing 36 is used to attach the fabric covering 34 to the frame, thereby allowing the fabric covering 34 to be removed for washing. The lacing 36 repetitively extends through one of a plurality of lace holes 37 which line the fabric covering 34, encircles the frame 12, and then enters the next consecutive lace hole 37. Alternatively, the fabric covering 34 may be attached to the frame with snap fasteners, wherein one end of each snap fastener is attached to a short strap and mates with a complementary end on the fabric covering 34 after encircling a portion of the frame 12 where it is attached.

Figure 4:
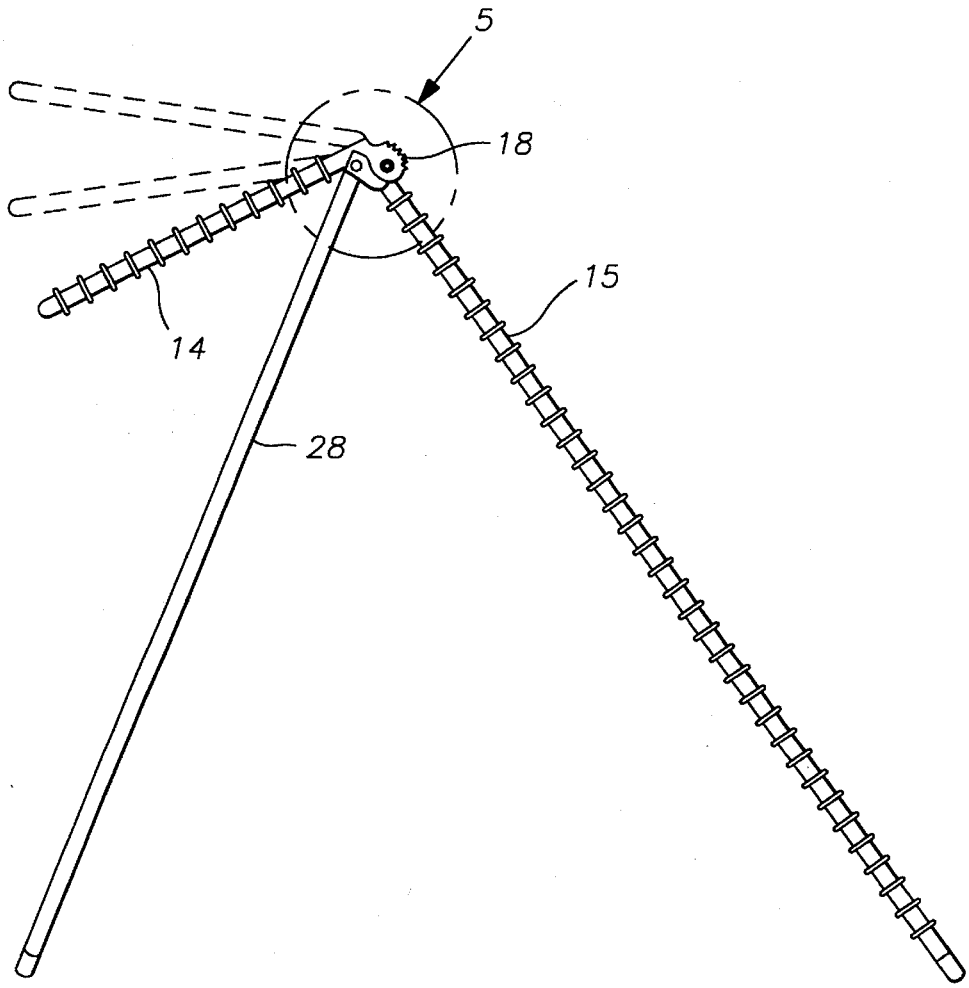
FIG. 4 is an elevational view of the invention, according to arrow 4 in FIG. 2, illustrating how the visor adjusts to various angles.

FIG. 4 illustrates how the hinge 18 operates to vary the angle of the visor 14 with respect to the lower panel 16. When a person is using the sun shade 10, they lay on the ground surface 11 with their shoulders between the legs 28 and their head under the lower panel 16. They can then pull the visor 14 downward until the visor 14 shades their head, but does not block sunlight from reaching the rest of their torso.

Alternatively, the sun visor 10 may be placed upon the ground to shade a baby or small child at the beach. The child can be place under the lower shade 16, and the visor adjusted accordingly. This method of providing shade to a child is far superior to other dangerous methods that are typically used.

Figure 5:
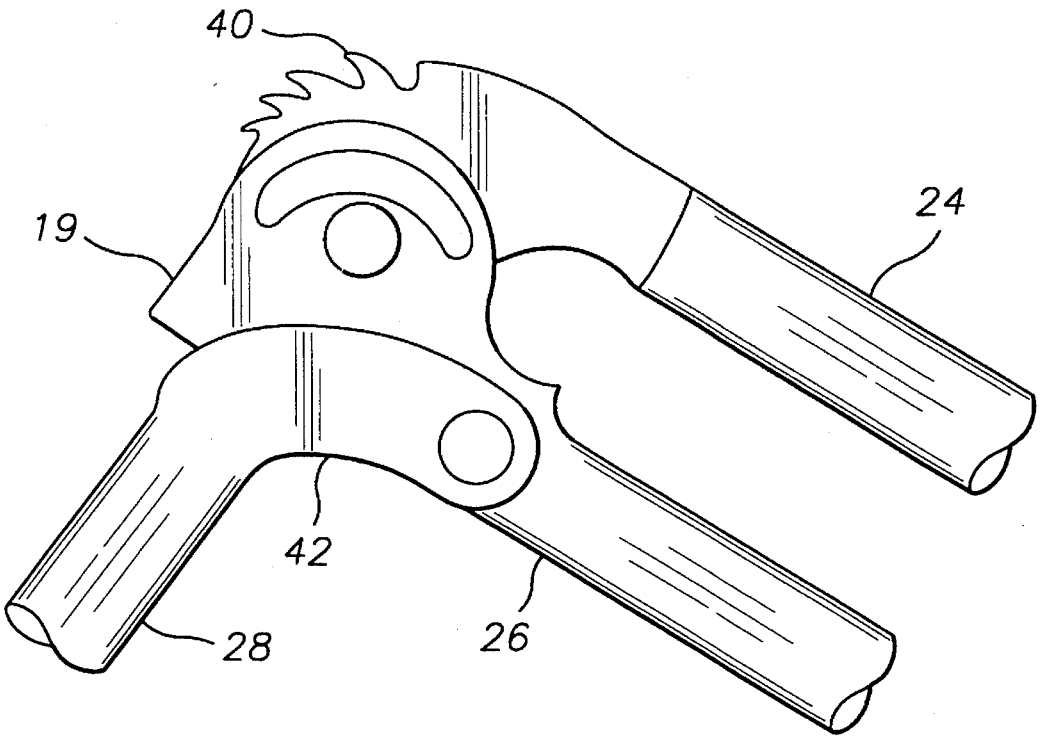
FIG. 5 is an elevational view of just the hinge coupler: an enlargement of the area indicated in circle 5 in FIG. 4.

FIG. 5 illustrates a hinge coupler 19, which forms one half of the hinge 18. The hinge coupler 19 joins the upper 24 strut with the lower strut 26, allowing the two to rotate within an angular field of approximately 180 degrees. As shown, the upper strut 24 and lower strut 26 are in a storage position. A ratcheting mechanism 40 allows the angle obtained by the rotation to be maintained. The leg 28 is attached to the hinge coupler 19 with a semi-circular hook 42, which allows the leg 28 to enter a position nearly parallel to the lower strut 26 for storage.

In conclusion, thus is created a sun shade that is lightweight, convenient to use and store, and effectively shades a person's head while allowing sunlight to reach the rest of their body.

What is claimed is:

1. A sun shade, for shading a person's head while they lay on the ground, comprising:

a visor having an upper edge and upper struts attached to the upper edge, the upper struts are substantially parallel to each other;

a lower panel having a lower edge which rests on the ground, the lower edge substantially parallel to the upper edge;

a hinge attaching the visor and lower panel and allowing adjustment of an angle between the visor and lower panel, the lower panel extending rearward from the hinge, the upper struts of the visor extending forward from the hinge; and a pair of legs, extending from the hinge and resting upon the ground to support the sun shade, the legs dividing the angle formed by the visor and lower panel, and wherein the angle formed by the visor and lower panel is obtuse when the lower edge and the legs rest on the ground.

2. The apparatus as recited in claim 1, wherein the visor and lower panel further comprises a fabric covering.

3. The apparatus as recited in claim 2, wherein the fabric covering is stretched between the upper edge and lower edge.

4. The apparatus as recited in claim 3, further comprising a tension bar, extending between the upper struts, tensioning the fabric covering, the tension bar substantially parallel to the upper edge.

5. The apparatus as recited in claim 4, wherein a utility pocket is attached in a shaded location at one of: the visor and the lower panel.

6. The apparatus as recited in claim 5, wherein the utility pocket is sewn to the fabric covering at the lower panel.

7. A sun shade method, for use by a person lying on a ground surface and having a head, shoulders, and a torso, selectively blocking sunlight to the face while allowing the sunlight to reach the torso, with a sun shade having a visor and a lower panel attached to the visor with a hinge that varies the angle between the visor and lower panel, and legs extending from the hinge, the legs dividing the angle between the visor and lower panel, comprising the steps of:

placing the sun shade on the ground with the lower panel resting against the ground surface and the legs resting against the ground surface;

lying on the ground surface underneath the sun shade with the shoulders of the person between the legs of the sun shade and with their head underneath the lower panel; and adjusting the angle of the visor to block the sunlight from the face while allowing it to reach the torso, the angle formed between the visor and lower panel being an obtuse angle.

8. The method as recited in claim 7, wherein the lower panel further comprises a utility pocket, and the method further comprises the step of placing an object in the pocket, the object selected from a book, sunglasses, a radio, and food.

9. The method as recited in claim 7, further comprising the steps of:

pivoting the visor about the hinge until the visor and lower panel form an obtuse angle; and swinging the legs to bisect the angle formed between the visor and the lower panel.

* * * * *